US006595780B2

(12) United States Patent
Singh et al.

(10) Patent No.: US 6,595,780 B2
(45) Date of Patent: Jul. 22, 2003

(54) METHOD TO DETECT INSTALLED MODULE AND SELECT CORRESPONDING BEHAVIOR

(75) Inventors: Harjit Singh, Redmond, WA (US); Margaret E. Winsor, Seattle, WA (US)

(73) Assignee: Microsoft Corporation, Redmond, WA (US)

( * ) Notice: Subject to any disclaimer, the term of this patent is extended or adjusted under 35 U.S.C. 154(b) by 95 days.

(21) Appl. No.: 09/782,575

(22) Filed: Feb. 13, 2001

(65) Prior Publication Data

US 2002/0150874 A1 Oct. 17, 2002

(51) Int. Cl.[7] ..... A63H 5/00
(52) U.S. Cl. ..... 434/258; 446/397
(58) Field of Search ..... 434/258, 259, 434/308, 311, 334, 343, 345, 367, 379; 446/297, 397, 404, 227; 273/237, 238

(56) References Cited

U.S. PATENT DOCUMENTS 5,451,178 A * 9/1995 Yorozu et al. ..... 446/175
5,538,432 A * 7/1996 Dondero et al. ..... 434/258
5,636,995 A * 6/1997 Sharpe ..... 434/317
5,813,861 A * 9/1998 Wood ..... 434/169
5,855,483 A * 1/1999 Collins et al. ..... 434/322
5,906,369 A * 5/1999 Brennan et al. ..... 273/238
6,287,560 B1 * 9/2001 Fujii ..... 424/127
6,290,565 B1 * 9/2001 Galyean ..... 446/99

* cited by examiner

*Primary Examiner*—Derris H. Banks
*Assistant Examiner*—Kurt Fernstrom
(74) *Attorney, Agent, or Firm*—Ronald M. Anderson

(57) ABSTRACT

A method and apparatus for identifying a module installed in a base from a plurality of different modules and selecting a set of functions corresponding to the installed module. A preferred embodiment is the Intelli-Table™ toy that includes three modules, each of which can be installed into an annular channel in the base. When a module is installed, a unique pattern of recesses or flat surfaces on the bottom of the module is detected by a first set of switches in the channel. Based on the unique state of these switches, the base selects a set of functions corresponding to the installed module. Each module includes a plurality of different movable elements that activate a second set of switches in the base. Moving an element activates a switch, causing the base to perform a function unique to that element and to the module installed.

47 Claims, 9 Drawing Sheets

METHOD TO DETECT INSTALLED MODULE AND SELECT CORRESPONDING BEHAVIOR

FIELD OF THE INVENTION

The present invention generally relates to a method and system to detect which of a plurality of modules is installed to select a corresponding functional behavior, and more specifically, to utilizing multiple sets of switches to identify an installed module and activate appropriate functions corresponding to the installed module.

BACKGROUND OF THE INVENTION

There are numerous interactive educational electronic toys with buttons that a child can press to produce a sound, cause a light to be energized, or cause another action to occur as a way of encouraging the child to learn the ABCs, counting, etc. However, most of these toys include buttons or other controls that are completely integrated with the toy and are thus limited in functionality and variety. For example, the Fisher Price™ Growing Smart™ telephone is a toy that includes integral buttons that can be activated by a child. Because each such toy is limited to the functions associated with the integrated buttons, a child may outgrow the toy or lose interest in it over time.

Some toys include a base and a plurality of objects that are designed to be removably coupled to the base. Use of a different object with the base expands its functionality, since each such removable object can enable different functions to be carried out. For example, the Neurosmith MusicBlocks™ toy includes a base with removable square blocks. Different electrical resistors are associated with metal contacts disposed on each face of the block. Metal pins on the base touch the metal contacts on one face to complete a circuit through the resistors through that face when a block is seated onto the base and a switch is activated (by pressing down on the block). A different musical sequence is produced through speakers in the base, depending upon the face that is seated on the base. This toy also includes various removable cartridges that interface with the base to produce different musical sounds when the same block face is seated onto the base. However, electronic components must be included in the base and in both the blocks and cartridges, which results in a relatively high cost for the toy.

Other toys provide a base with removable objects that contain no electrical components. These removable objects mechanically activate switches on the base of the toy to cause different functions on the base to occur. A surface of each removable object that contacts the base has a different pattern of recesses and flat surfaces that interface with a corresponding pattern of switches on the base. When an object is placed onto the base, a recess does not activate a corresponding switch, while a flat surface does. For example, in one such toy, removable plastic farm animal figures interface with a plastic base configured as a pick-up truck to produce the sound of the animals. One animal at a time can be placed in the bed of the pick-up truck toy in which four switches are disposed. On the bottom of each removable farm animal is a different pattern of recesses and flat surfaces that corresponds to the disposition of the four switches. Since a different pattern is provided on the bottom of each farm animal, a different switch is activated for each of four different animals, thereby producing the appropriate animal sound. While these animals are removable and are simply die-cast plastic without any electronics, the base only produces a different sound associated with each of the four animals. Thus, this toy is functionally equivalent to a toy with integrated buttons, because only one animal noise is produced per switch (i.e., per animal). The animal simply controls the specific switch that is pushed when the animal is inserted into the pick-up truck bed.

It is desirable to provide a more flexible device that employs a common set of switches to accomplish a variety of different functions associated with each of a plurality of different modules. Utilizing a single base with a variety of removable modules helps to reduce costs, because the base unit, which is used with all of the modules, includes all of the electronic circuitry, and less expensive, removable modules can be used to provide a wide variety of alternate functions. Currently, no other toy or other device of this flexibility is available.

SUMMARY OF THE INVENTION

In accord with the present invention, a method is defined for determining a functional behavior of a base of an electronic device as a function of one of a plurality of different modules that is coupled to the base. This method enables a single electronic base to be used with the plurality of different modules and to automatically select a set of functions associated with the module that is coupled to the base by the user. After a user couples the selected module to the base, the base detects the module that was selected as a function of its configuration, which interacts with at least one switch in the base. The base is thus enabled to perform a set of functions based on the selected module that was detected. Each function is performed in response to movement of an element, or elements, included on the selected module. Preferably, each set of functions associated with a module is related to a common theme, and each movable element indicates a function to be implemented related to that theme. Thus, the functional behavior implemented by the base is dependent upon the module that is coupled to the base by the user.

The configuration of the modules provides a unique pattern of flats and recesses corresponding to locations on the base where a module interfaces with function switches. Installing a module and activating a function switch by moving an element may display a pattern, produce a sound, and/or provide another sensation to the user. Preferably, the switch state that detects the module is determined when the base is energized after the module is installed. Alternatively, the switch state indicative of the module is detected upon changing a module while the base is energized. Preferably, the base is de-energized when a module is removed from the base.

The state of one or more function switches changes when a user moves an element on the selected module, and a function associated with the function switch(es) is then implemented by the base. A pair of the function switches can also be connected in parallel if both function switches in the group are not activated by different elements on a module. Thus, one input line to electronics in the base can be used for two function switches, instead of requiring two separate input lines, which enables the electronic circuitry to be simpler and less expensive.

The modules provide elements that can be moved by pushing, sliding, toggling, spinning, or other dynamic action. When an element is moved, a function switch is activated and a function is implemented. Further, when an element is moved again, a successive predetermined function can be implemented, such as saying the letters of the alphabet. Each movable element preferably includes some indicia of its corresponding function such as its shape, color, labeling, or design pattern.

Another aspect of the present invention is directed to apparatus that implements a selected function from among a plurality of different sets of functions. The apparatus includes a base and a plurality of modules and other components that operate in a manner generally consistent with the steps of the method discussed above.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
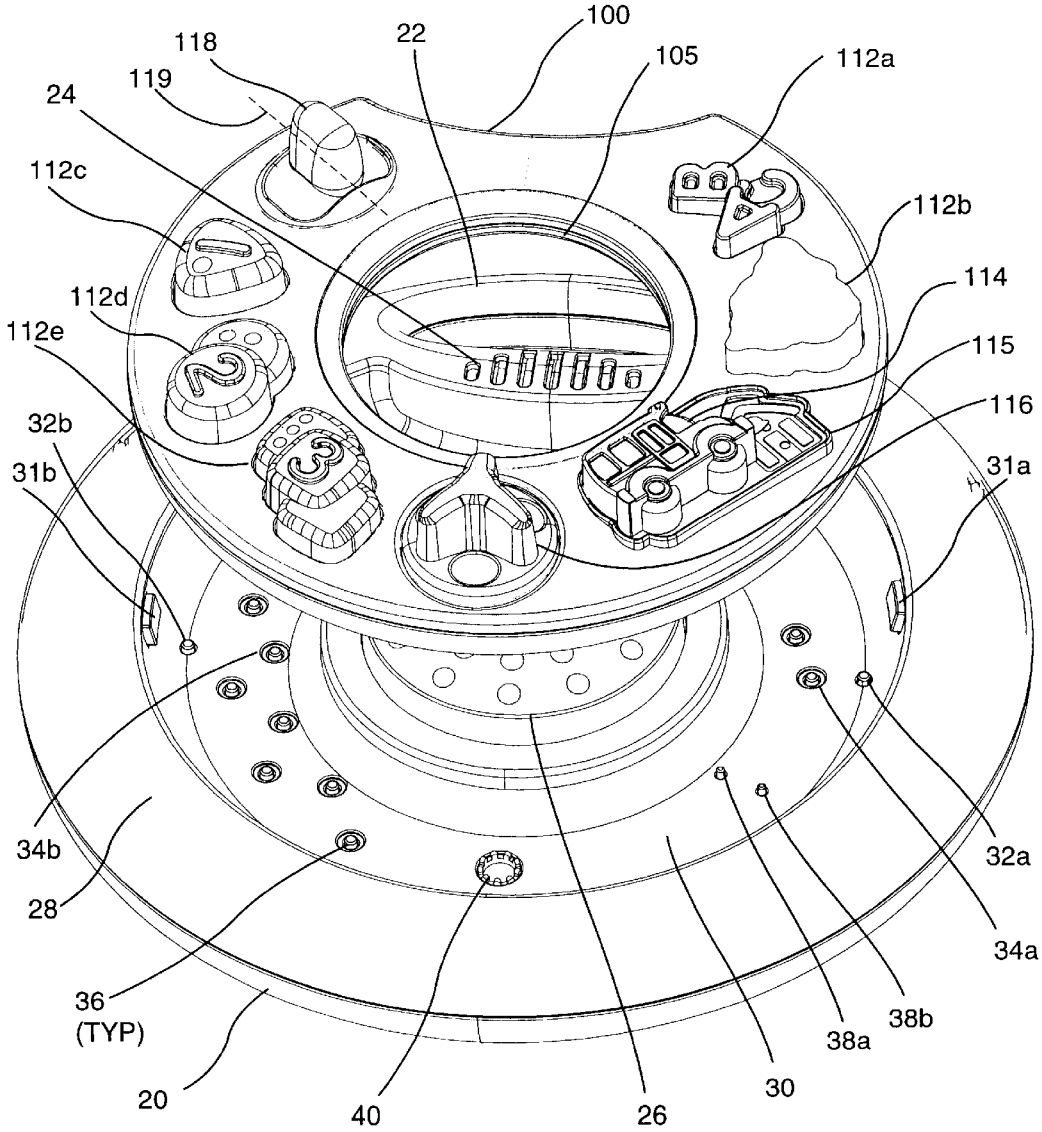
FIG. 1 is an exploded isometric view of a preferred embodiment of the present invention, in which a "Basics" module is shown with a base.

FIG. 1 illustrates a preferred embodiment of the present invention, which is currently being marketed by Fisher Price™ as the Intelli-Table™ educational toy for children, ages 12 months to 36 months. Components of the Intelli-Table™ include a base 20 and a plurality of modules 100, 200, and 300 (only module 100 is illustrated in FIG. 1). The Intelli-Table™ also includes a four-legged stand for supporting the base and storing the modules, but since it is not required for use of the preferred embodiment of the present invention, it is neither shown nor further discussed herein. Base 20 is generally shaped as a toroid, and more specifically, in the form of a circular disk with a cross section that is approximately oval in shape. Preferably, base 20 is made of a child-safe plastic, and is further molded to include a handle 22 by which a user may grasp base 20 to carry it with one hand.

Base 20 further includes speaker slots 24 through which audio signals (sounds) are emitted from an internal speaker that is not shown in this FIGURE. A display 26 that is generally circular in shape, is disposed at a center of base 20, and is sized to extend through an orifice 105 in the center of each module. Display 26 is also a movable element corresponding to a large button that must be depressed when a module is installed into a channel 30, in order to apply power and activate the play functions of base 20. Depressing display 26 after a module has been installed causes base 20 to play a song through speaker slots 24 and display a light pattern within display 26 that follows the notes of the song. To provide the light pattern, display 26 includes a plurality of multi-color light emitting diodes (LEDs) that are enclosed by the display cover, which is translucent so that the colored light emitted by the LEDs is readily visible through the cover. Base 20 has an outer annular surface 28.

Between display 26 and an outer annular surface 28 is disposed annular channel 30 into which module 100 or one of the other modules is seated to engage the module in the base. Disposed on opposite sides of channel 30 are locks 31*a* and 31*b* that secure a module in the annular channel. Locks 31*a* and 31*b* retract when release buttons (not shown) on the bottom of base 20 are depressed, enabling the module to be removed. Disposed on a bottom surface of annular channel 30 adjacent to locks 31*a* and 31*b*, respectively, are spring-loaded pins 32*a* and 32*b*. These pins exert a continuous pressure against a module seated in channel 30, ensuring that the module pops out of channel 30 when locks 31*a* and 31*b* are released.

Also disposed on the bottom surface of channel 30 are module detection switches 34*a* and 34*b*. These switches are activated by a flat surface on the bottom of a module when the module is seated and locked into annular channel 30. A unique pattern of flat surfaces and recesses on the bottom of each module activates or does not activate module detection switches 34*a* and 34*b*, respectively. Together, these two switches define four unique states, thereby enabling up to four different modules to be detected. This approach is somewhat analogous to the toy truck discussed above in the Background of the Invention, but the present invention needs only two switches to recognize up to four modules (although only the three modules are provided in a preferred embodiment of the present invention), because the base uses binary logic to interpret the pattern of the two module detection switches 34*a* and 34*b*. These two module detection switches comprise a first set of switches, appropriately referred to as the module detection set.

Also disposed on the bottom surface of annular channel 30 is a second set of switches, referred to as the element detection set. This set includes button switches 36, slider switches 38*a* and 38*b*, and spinner switches (not shown in this view) that are activated by a base spinner gear 40. For example, button switch 36 will change state when depressed by a movable element 112*e* on module 100. A button type movable element, such as movable element 112*e*, typically includes a push rod (not shown) depending downwardly from its lower surface to actuate one of the button switches when the movable element is depressed. A helical spring (not shown) that is disposed around the rod inside the module biases the movable element upwardly, resisting the force that is applied to depress the movable element. Thus, when button type movable element 112*e* is depressed by a user, the push rod depresses switch 36. When the user releases the button element, the helical spring returns the button type movable element to its original position.

A pair of slider switches 38*a* and 38*b* are used to detect a position of a slider, such as a bus slider 114. In a manner similar to that employed for the module detection switches, the slider detection switches 38*a* and 38*b* together detect four unique positions of a slider. As a slider is moved to each of four detented positions, corresponding slider switch actuator bars (not shown) that depend downwardly from the slider within module 100 (and module 200) actuate slider detection switches 38*a* and 38*b*. A slider switch actuator bar covers one of two orifices in the bottom surface of the module, depending upon the detent position of the slider on the module; the orifices are aligned with slider detection switches 38*a* and 38*b* when the module is installed in base 20. When a slider switch actuator bar covers a orifice, it depresses the corresponding slider detection switch.

To detect rotational motion of a spinner movable element, such as basics spinner 116, a base spinner gear 40 is rotated by a module spinner gear (not shown) depending downwardly from the spinner movable element. The teeth of the two gears engage when a module is seated into annular channel 30 of base 20. Base spinner gear 40 moves leaf springs (not shown) within base 20 as the base spinner gear rotates. A pair of lobes on a cam (not shown) coupled to base spinner gear 40 flexes the leaf springs to activate and deactivate a pair of spinner switches (not shown) within base 20 in an alternating sequence, as the spinner detection gear rotates. The lobes are offset by 90 degrees relative to each other and are 180 degrees in "length." This way, when the cam makes one complete rotation, the pair of spinner switches are actuated through four successive states. Base 20 can detect a current state and a previous state to determine the direction of rotation.

As illustrated in FIG. 1, module 100 is also generally shaped as a toroid, and more specifically, is disk-shaped with a cross section that is approximately oval about center orifice 105. Preferably, module 100 is formed of a plastic that meets safety regulations for use by children. Module 100 has a plurality of movable elements, including a plurality of buttons 112*a*–112*e*, slider 114, spinner 116, and a toggle 118. Each movable element is movable by a user to actuate at least one of the switches in the element detection set disposed within base 20.

For example, as noted above, button 112*e* can be depressed by a user to actuate button switch 36. Each button causes a unique function to be implemented by base 20. Each repeated depression of button 112*a* causes base 20 to announce a successive letter of the alphabet, announce a word that starts with the announced letter, and display a light pattern on display 26. Button 112*b* causes base 20 to produce one of a plurality of animal noises, announce the name of the animal corresponding to that animal noise, and display a unique light pattern on display 26. Button 112*c* causes base 20 to announce the number one, produce one distinctive sounds, and display a unique light pattern on display 26. Similarly, buttons 112*d* and 112*e* cause base 20 to announce the numbers two and three, respectively, produce two and three distinctive sounds, and display a unique light pattern on display 26.

In addition to simple buttons, slider 114 can be moved from left to right within a bezel 115. Slider 114 includes a pair of switch actuator bars (not shown) within module 100. As slider 114 is moved, the switch actuator bars block or open a pair of orifices (not shown) in the bottom surface of module 100, causing slider switches 38*a* and 38*b* to change state (one of four possible states). At each of the four detent slider positions, base 20 announces a word that has a natural opposite, such as "big," and displays a unique light pattern on display 26 that corresponds to the announced word. When slider 114 is moved to a different position, base 20 announces the opposite word, e.g. "little," and displays a unique light pattern on display 26 that corresponds to the announced word.

As described above, rotating spinner 116 also rotates a mechanically coupled module spinner gear (not shown) protruding through the bottom of module 100. The module spinner gear engages base spinner gear 40. Activating a spinner switch causes base 20 to implement a predefined function, e.g., play one note of a song at a time and display a unique light pattern for each note of the song.

When toggle 118 is pushed in either of two directions, it rotates up to approximately 30 degrees about an axis 119. When toggle 118 is released, a spring (not shown) within module 100 forces toggle 118 back to the center position shown in FIG. 1. When toggle 118 is pushed in either of the two directions, it actuates a corresponding switch in annular channel 30 of base 20. For example, moving toggle 118 causes base 20 to produce a single "boing" noise, and display a unique light pattern on display 26.

The movable elements and corresponding functions of base 20 that are associated with module 100 are generally designed to enhance an infant's discovery of basic audio and visual patterns such as the ABCs and counting, and to enhance gross motor skills. Module 100 is thus referred to as the Basics module. The Intelli-Table™ toy also includes a removable module generally designed to enhance a toddler's understanding of music and finer motor skills. Fittingly, this module is referred to as the Music module. The Music module (module 200 in FIG. 3B) includes a plurality of movable elements appropriate for music, including a small piano keyboard, a trombone slider, and a spinning note (none of which are shown).

Figure 2:
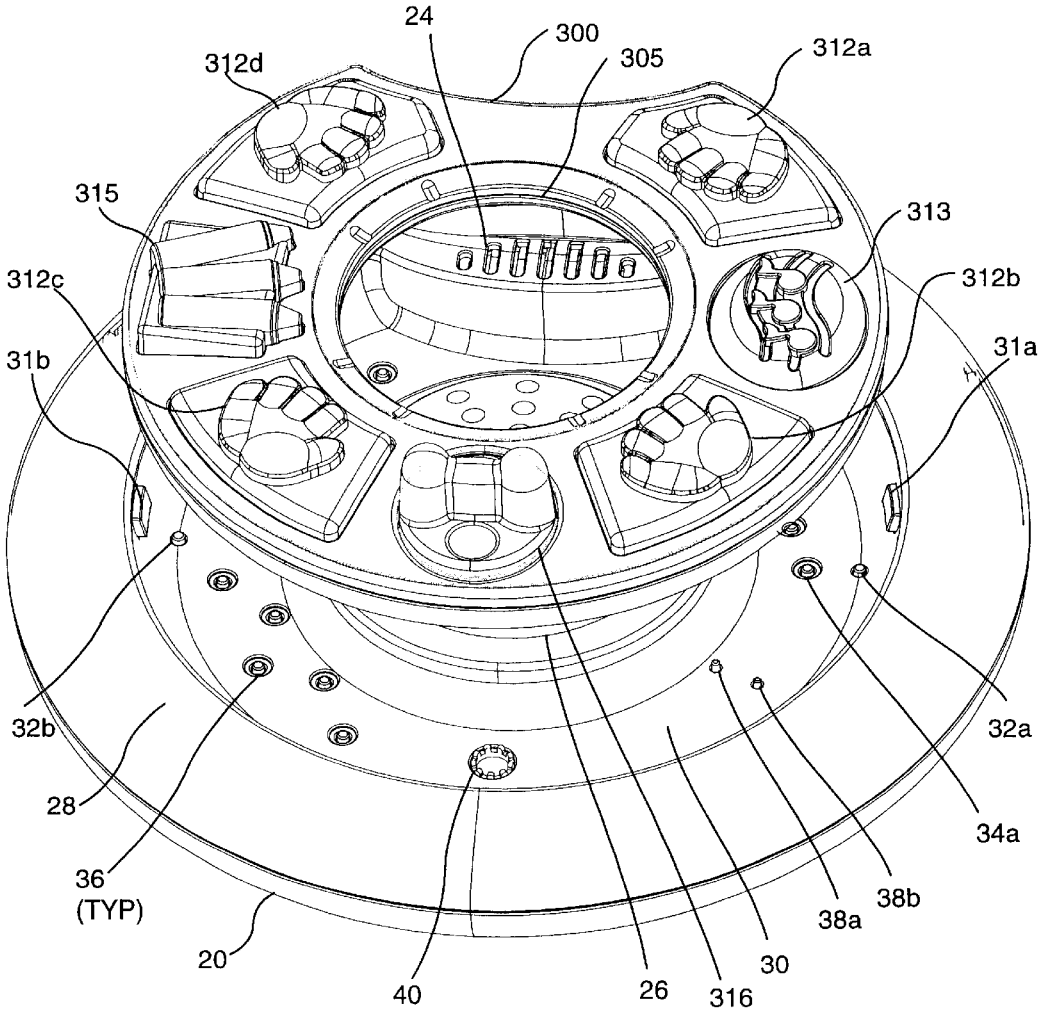
FIG. 2 is an exploded isometric view of present invention, in which a "Games" removable module is shown with the base.

FIG. 2 illustrates removable module 300, which is generally designed to enhance a pre-schooler's development of strategy and pattern matching skills. Module 300 is referred to as the Games module because it enables a user to play a plurality of simple pattern games. Module 300 includes only button elements and a spinner. These movable elements mechanically operate in the same manner as the movable elements on the Basics and Music modules. However, because each module causes module detection switches 34*a* and 34*b* to change to a unique state, the movable elements of each different module cause base 20 to execute a different set of functions.

For example, game buttons 312*a*–312*d* operate generally in the same manner as the buttons on Basics module 100, but enable a user to play four game functions instead of reciting ABCs and numbers as the Basics module does. In many cases, game buttons 312*a*–312*d* activate the same function switches in the base as the Basics buttons, but the function switches in the Games module cause the base to perform different functions. The functions implemented by the base in response to a movable element actuating a function switch thus depend upon the module installed in the base. Game buttons 312*a*–312*d* enable a player to initiate a new game and provide input to the game. For instance, in a "Follow the Leader" game, display 26 displays a light pattern adjacent to one of the game buttons, such as game button 312*a*. In response, the user is expected to press game button 312*a*. If the user does not press game button 312*a*, base 20 produces an "oops" sound. However, if the user press game button 312*a*, base 20 produces a congratulatory sound. Display 26 then first displays the light pattern adjacent to game button 312*a*, but then moves the light pattern to be adjacent to a different game button, such as game button 312*c*. In response, the user is expected to press game button 312*a*, followed by game button 312*c*. If the user does not press the game buttons in the indicated order, base 20 produces the "oops" sound. But, if the user presses the game buttons in the indicated order, base 20 provides the congratulatory sound. The game then continues with additional game buttons.

The other two buttons enable the user to change the audio sounds and display colors. Specifically, a sound button 313 enables the user to select from a plurality of audio sounds for various functions of the Game module. Similarly, a color button 315 enables the user to select which of the three colors are displayed for various functions of the Game module.

A spinner 316 operates in the same manner as spinner 116 on module 100 (in FIG. 1). As spinner 316 is rotated, display 26 illuminates a helical sequence of lights from the outer edge to the center of display 26. At each step in the sequence, base 20 produces a frog sound. The helical sequence on the display reverses direction if spinner 316 is rotated in the opposite direction.

Figure 3C:
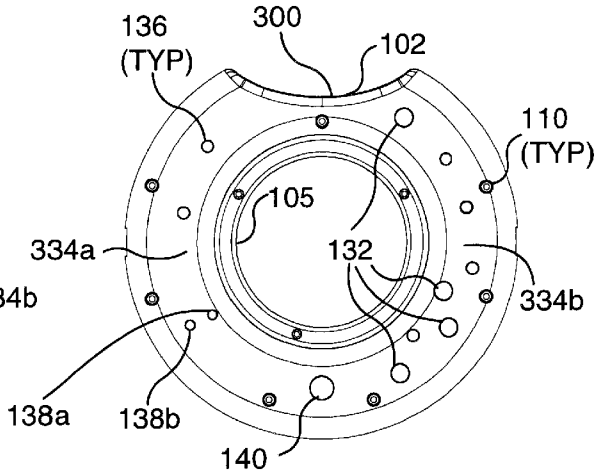
FIG. 3C is a bottom view of a Games removable module with its associated pattern of recesses.
Figure 3B:
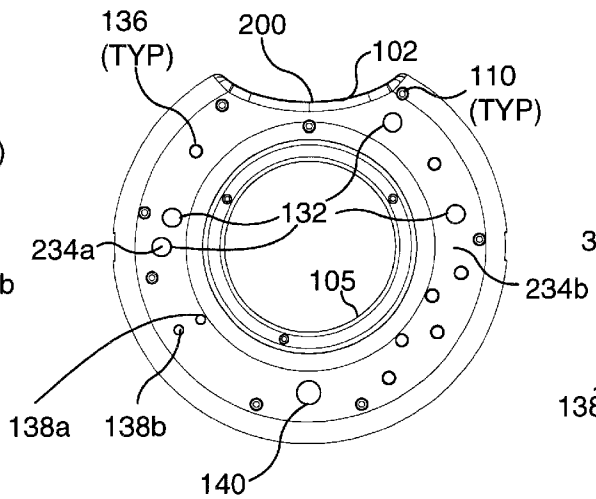
FIG. 3B is a bottom view of a "Music" removable module with its associated pattern of recesses.
Figure 3A:
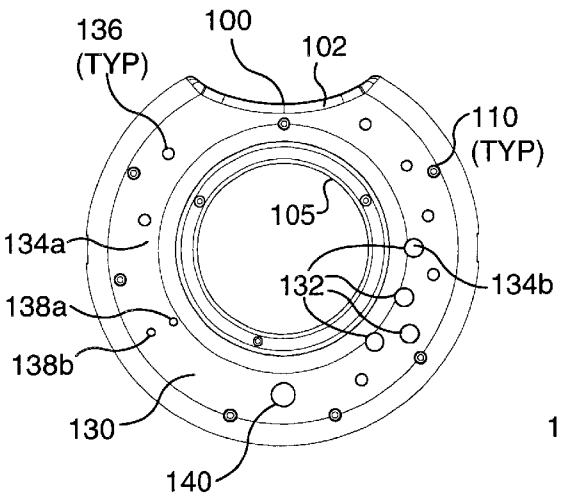
FIG. 3A is a bottom view of the Basics removable module, showing the pattern of recesses employed thereon.

FIG. 3A illustrates a bottom view of Basics module 100. As described earlier, the module is generally circular in shape, but contains a concave cutout 102 along portion and center orifice 105, both of which aid in aligning and seating the module at a fixed position in the annular channel of the base. A module is typically constructed of an upper and lower half (not shown) that are held together with recessed fasteners 110.

Generally matching the shape of the bottom surface of the annular channel in the base is a flat surface 130 on the module. A flat surface at a location 134*a* corresponds to the location of module detection switch 34*a* in base 20 (shown in FIG. 1). Flat surface 130 at location 134*a* will depress and actuate module detection switch 34*a* when module 100 is seated into annular channel 30 of base 20. Disposed at a diametrically opposite location 134*b* is a recess 132 that corresponds to module detection switch 34*b* on base 20. Recess 132 at location 134*b* will not actuate module detection switch 34*b* when module 100 is seated into annular channel 30 of base 20. Thus, the unique state of an actuated module detection switch 34*a* and an unactuated module detection switch 34*b* will indicate to base 20 that Basics module 100 is seated in annular channel 30.

A plurality of recesses 132 and element actuation orifices 136 are disposed in flat surface 130 in a pattern unique to Basics module 100. The recesses prevent a corresponding element detection switch in the base from being actuated. The push rod of a movable element on the module extends through an element actuation orifice so that the push rod can actuate a corresponding function switch in the base. Element actuation orifices 138*a* and 138*b* correspond to slider switches 38*a* and 38*b* (shown in FIG. 1). As discussed above, when a slider is moved, slider actuation orifices 138*a* and 138*b* are blocked or unblocked in a unique pattern for each of the four detent positions of the slider, and when a slider actuation orifice is blocked, the corresponding slider detection switches in the base is actuated.

Also as described above, a module spinner gear 140 rotates as a spinner is rotated and engages the base spinner gear in the base.

FIG. 3B illustrates a bottom view of Music module 200. Recess orifices 132 and element actuation orifices 136 are arranged in a different unique pattern corresponding to the layout of the different movable elements and different functions associated with Music module 200. A recess 132 at a location 234*a* and a flat surface at an opposite location 234*b* provide a different unique pattern to the module detection switches, enabling the base to detect the presence of Music module 200. However, slider actuation orifices 138*a* and 138*b* are in the same location as the corresponding orifices for the Basics module. Nevertheless, activation of the corresponding slider switches results in a different function being implemented by the base, because the base will detect that the Music module is installed.

Similarly, module spinner gear 140 is in the same location as the corresponding module spinner gear on the Basics module in order to engage with the base spinner gear in the base, but its rotation results in a different function being implemented by the base because the base detects that the Music module is installed.

FIG. 3C illustrates the bottom of Games module 300. Games module 300 provides yet another unique pattern of recesses 132 and element actuation orifices 136, corresponding to the unique movable elements and functions associated with Games module 300. The Games module also includes a unique pattern of two flat surfaces at locations 334*a* and 334*b* to activate both of the module detection switches in the base.

Table 1 summarizes the module identification patterns that enable the base to determine which module is installed. A "0" corresponds to a recess and a "1" corresponds to a flat surface.

TABLE 1

| | LOCATION a | LOCATION b |
|---|---|---|
| MODULE 100 | 1 | 0 |
| MODULE 200 | 0 | 1 |
| MODULE 300 | 1 | 1 |

Figure 4:
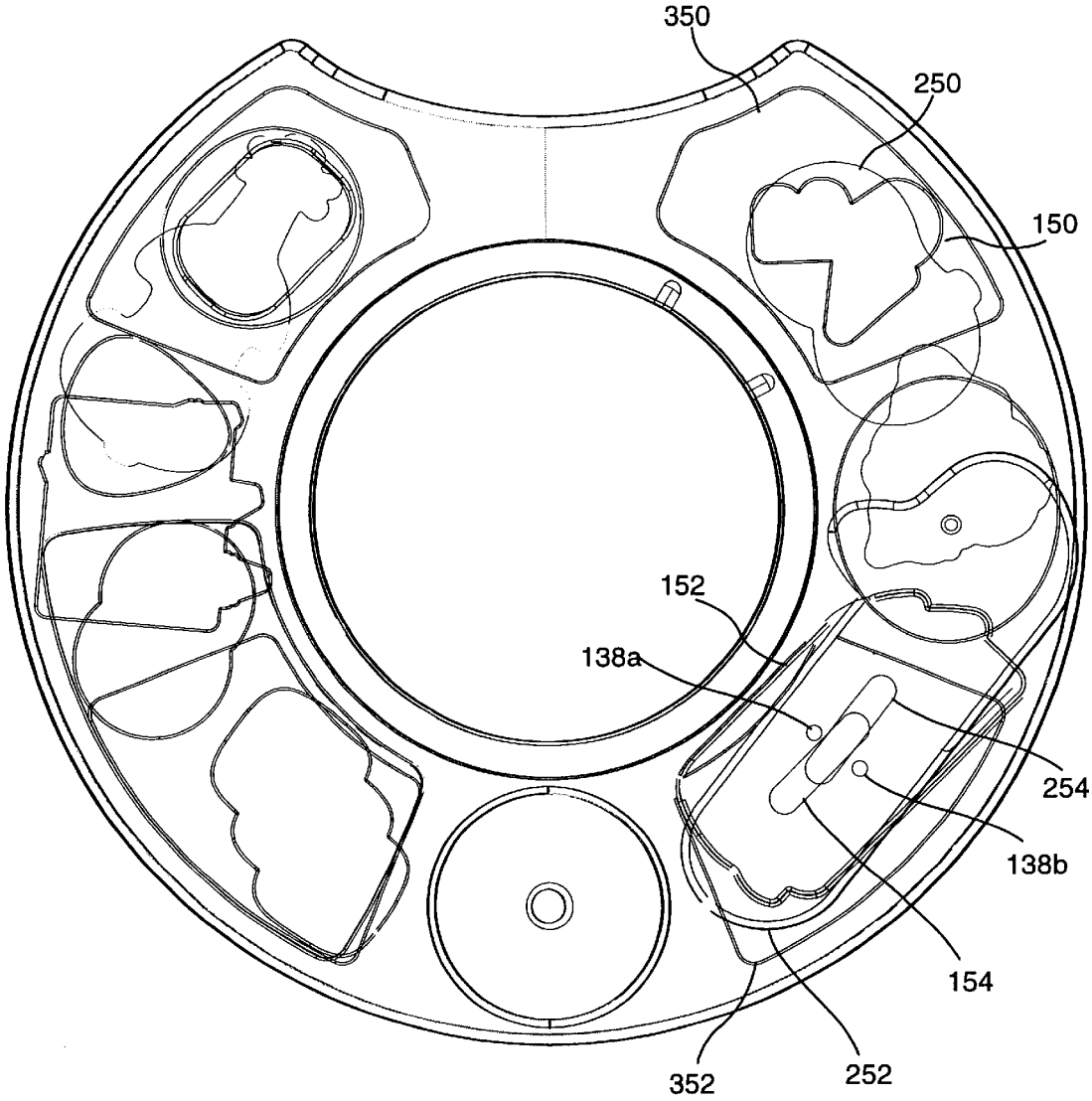
FIG. 4 is a composite overlay top plan view of the three removable modules of FIGS. 3A–3C, showing the disposition of the movable elements on each.

FIG. 4 illustrates a composite overlay of the movable elements for each module discussed above. An outline 150 corresponds to movable element 112*a* shown in FIG. 1; an outline 250 corresponds to a movable element in Music module 200; and an outline 350 corresponds to movable element 312*a* shown in FIG. 2 for Games module 300. Similarly, an outline 152 corresponds to slider element 114 in the Basics module shown in FIG. 1, and an outline 252 corresponds to a slider element on Music module 200. An outline 352, however, corresponds to a button element 312*b* in Games module 300, because there are no sliders in Games module 300. In this case, only one slider detection switch is used in the base, so that it becomes equivalent to a button type movable function switch. In the case of the Basics module and the Music module, both of the slider detection switches are used, as is shown by slider actuation orifices 138*a* and 138*b*. Also used in these two modules are slider slots 154 for the Basics module and 254 for the Music module.

Figure 5:
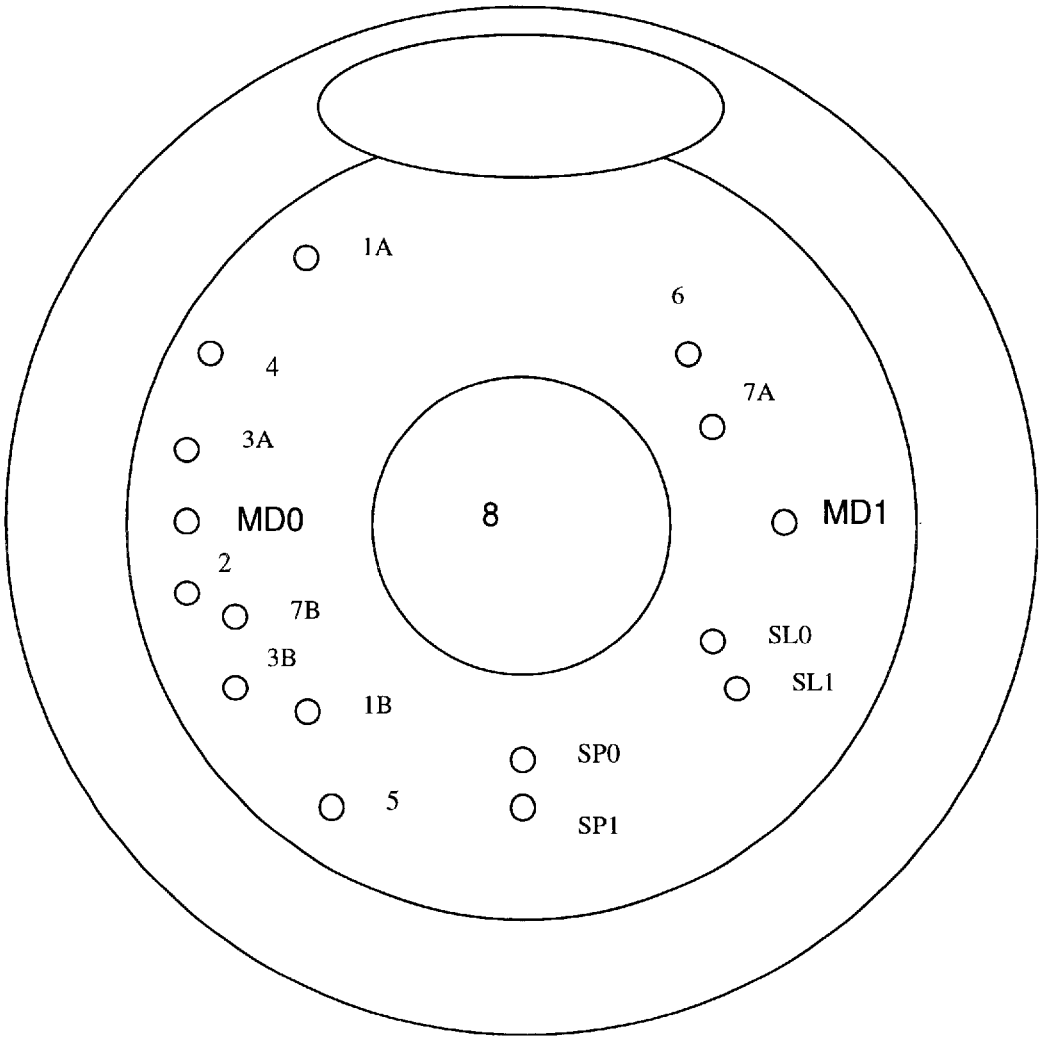
FIG. 5 is a plan view illustrating the switch locations in the base.

FIG. 5 illustrates the layout of switch locations in the base. Module detection switches at locations MD0 and MD1 are used to identify the installed module. Slider switches at locations SL0 and SL1 are used to detect a detent position of a corresponding slider. Spinner switches inside the base at locations SP0 and SP1 are used to alternately activate and deactivate functions associated with the spinner. The remaining switch locations correspond to button type movable elements, including the display button at a center location 8.

There are a total of 11 button switches. However, analysis of the overlay of movable elements (shown in FIG. 4) indicates that not all button switches are used for each module. Thus, some of the button switches are electrically connected in parallel to reduce the number of actual input lines needed for by the electronic circuitry in the base. For example, switches from locations 1A and 1B are connected in parallel. The Basics module uses a switch at location 1A with toggle 118 (shown in FIG. 1). However, the Basics module does not use a switch at location 1B for any movable element. Thus, the switches at locations 1A and 1B are connected in parallel as a single input to the electronic circuitry. When the Basics module is installed, only the switch at location 1A will actually provide an input to the electronic circuitry disposed in the base. The switch at location 1B will remain unused while the Basics module is installed. Thus, the switches at locations 1A and 1B can be connected in parallel without risk of providing two interfering switch states on the same input line.

In contrast, the Games module uses a switch at location 1B, but does not use a switch at location 1A. Thus, when the Games module is installed, only the switch at location 1B can be actuated. Again, there is no risk that two interfering switch states will be provided on the same input line. Therefore, it is safe to connect the switches at locations 1A and 1B together in parallel to provide input on the same input line. Connecting some of the switches together in parallel reduces the number of input lines required in the electronic circuitry, yet enables a larger number of switches to be provided for a correspondingly larger number of movable elements on all of the modules. This technique provides more movable elements without increasing the cost and complexity of the input processing system. As illustrated, the 11 switches require only eight input lines.

Figure 6:
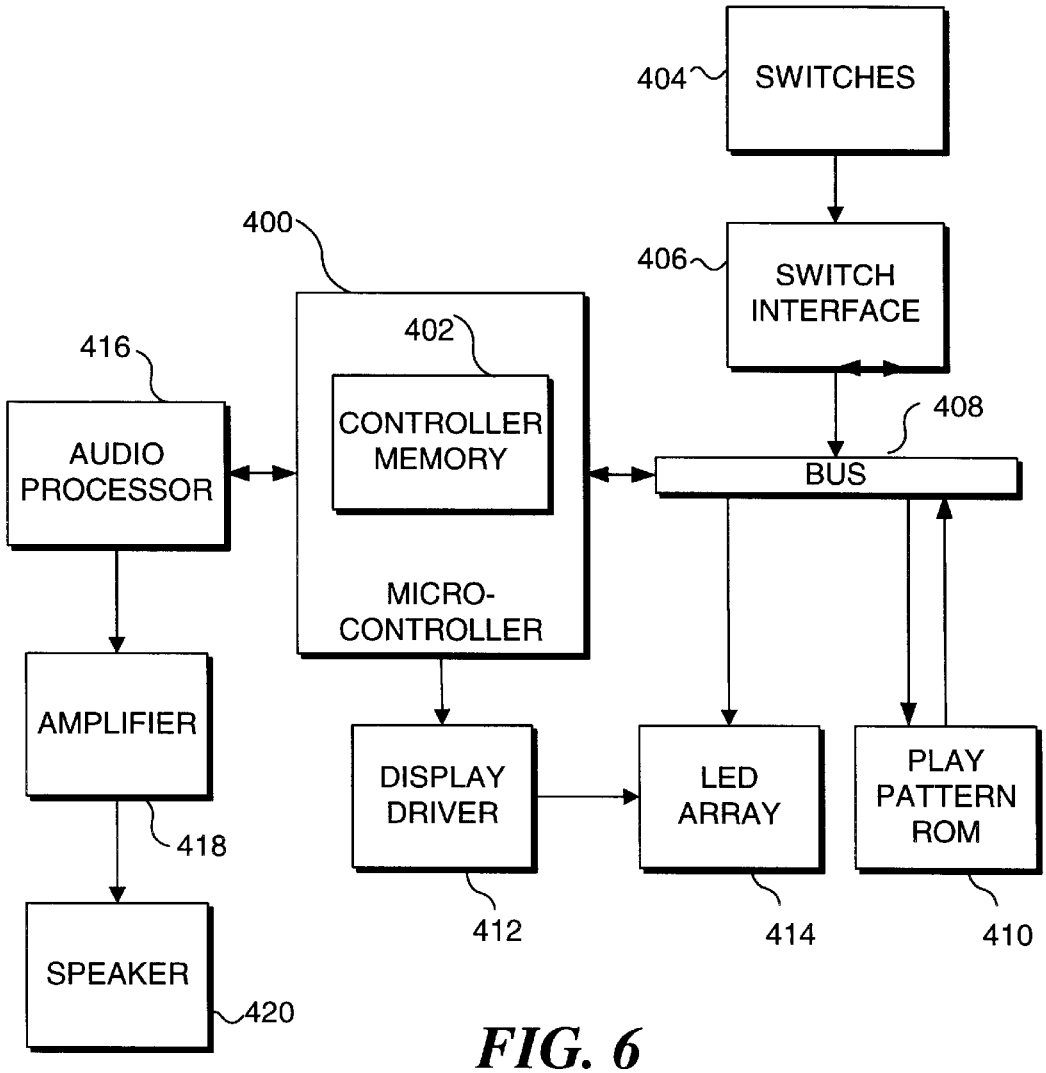
FIG. 6 is a block diagram of the functional components used in the present invention for processing switch inputs to select and provide an appropriate display and audio output.

FIG. 6 is a block diagram of the electronic system included in the base for processing switch inputs to select and provide the appropriate display and audio output functions in response to the user moving a movable element on one of the modules. At the heart of the electronic system is a microcontroller 400, which in this preferred embodiment of the present invention is a Microchip Corporation, Model PIC16LCR65A-04 microcontroller. It will be understood that many other types of microcontrollers, or processors, application specific integrated circuits (ASICs), or hard-wired logic controllers, or other types of logic devices can alternatively be used in the electronics system. Microcontroller 400 in this embodiment of the system also includes a controller memory 402, which is a combination of random access memory (RAM) and read only memory (ROM) for storing machine instructions that are executed by the microcontroller to interpret switch inputs and select the appropriate display and audio output functions that will be implemented. A block 404 represents the switches disposed in the base that provide input signals to a switch interface 406. Microcontroller 400 is in communication with switch interface 406 in order to enable and disable switch interface 406 as the microcontroller handles input, output, and other processing functions. Switch interface 406 is a conventional electronic circuit that protects against current and voltage spikes on the input lines and routes the input signals to a bus 408. Bus 408 may be any typical input/output bus that is compatible with the microcontroller. The bus makes the input signals available to microcontroller 400 and routes other signals to the appropriate processing element.

Also connected to bus 408 is a Play pattern ROM 410. Stored in Play pattern ROM 410 are a plurality of machine instructions and data for functional Play patterns, display patterns, and audio patterns used by microcontroller 400, in response to the switch input signals. Play pattern ROM 410 in this preferred embodiment is a Mask read only memory (ROM) that cannot be changed.

When microcontroller 400 interprets a switch input signal, the microcontroller obtains the machine instructions and data for the corresponding play pattern, display pattern, and audio pattern from the play pattern ROM. The machine instructions cause microcontroller 400 to create the appropriate display pattern on LED array 414 by sequencing display driver 412 and simultaneously outputting data on bus 408. LED array 414 is organized in a logical array of five columns by sixteen rows. The columns of LED array 414 are connected to display driver 412. The rows of LED array 414 are connected to bus 408. To create the display pattern on LED array 414, the microcontroller enables one column of LED array 414 via display driver 412 and simultaneously drives the appropriate row pattern via bus 408. By rapidly sequencing through the five columns of the LED array, the microcontroller is able to create what appears to the human eye to be a steady display.

Similarly, microcontroller 400 communicates audio commands to an audio processor 416. Audio processor 416 executes the audio commands and provides output signals to an amplifier 418, which modulates the output signals and delivers corresponding audio signals to a speaker 420, which thus produces the various sounds in response to the microcontroller.

Figure 7:
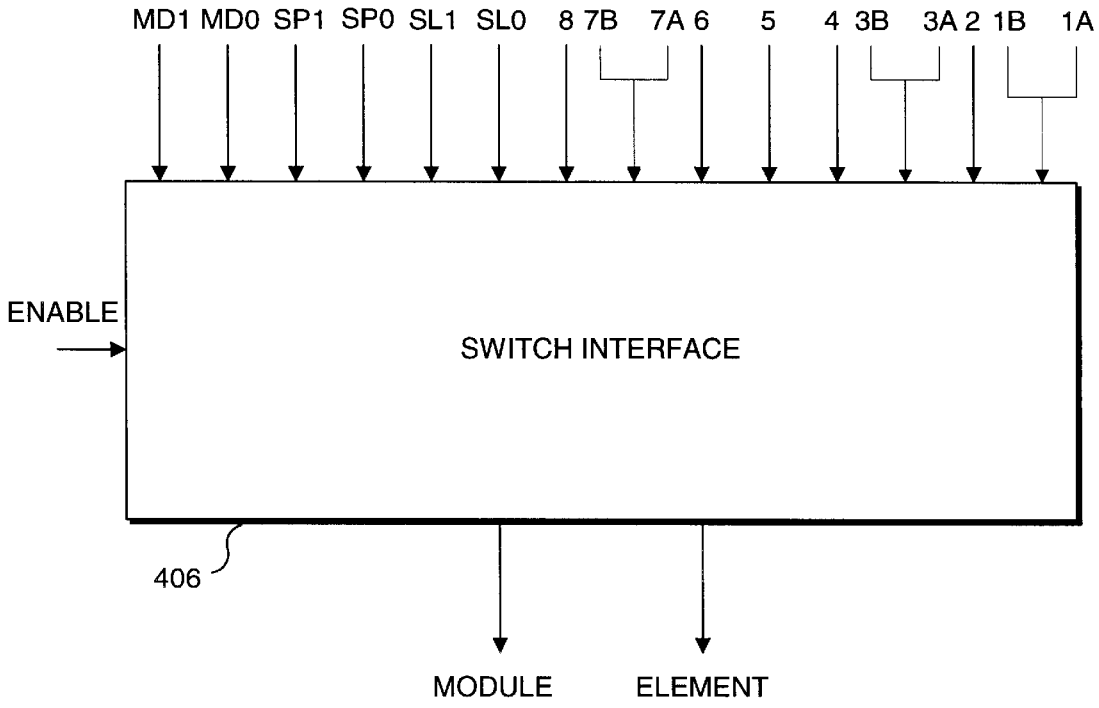
FIG. 7 is a schematic diagram of inputs and outputs for a switch interface used in the system.

FIG. 7 illustrates inputs and outputs for switch interface 406. This Figure illustrates that some input switches are connected in parallel to the same input line. For example, switches at locations 1A and 1B are connected in parallel to the same input line as described above. Similarly, switches at locations 3A and 3B are connected in parallel, as are switches at locations 7A and 7B. Also as described above, one or more enable lines sequence switch interface 406 as the microcontroller multiplexes between the different devices. Switch interface 406 provides two primary outputs, a module output and an element output. The module output indicates the particular module installed in the base by reflecting the states of the module detection switches at locations MD1 and MD0 (in FIG. 5). The element output indicates the movable element that was last activated.

Figure 8:
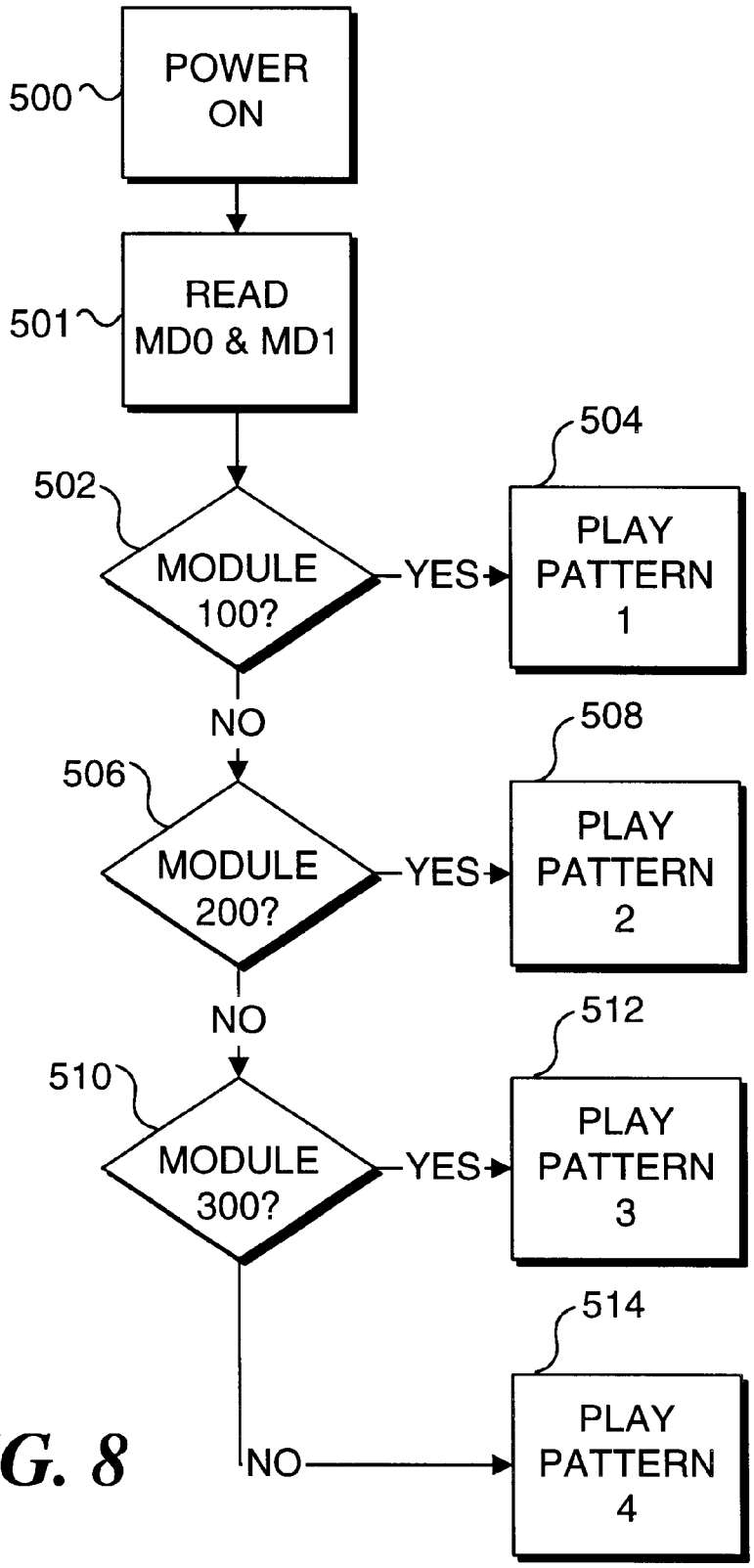
FIG. 8 is a flow diagram of the logic used by the system to identify the removable module that is coupled to the base.

FIG. 8 is a flow diagram of the module detection logic used by the processing system disposed in the base. At a block 500, power is applied by actuating display 26 (shown in FIG. 1. At a block 501, the module detection switches at locations MD0 and MD1 are read to determine their state. At a decision block 502, the state of the module detection switches is used to determine whether Basics module 100 is installed in the base. If so, play pattern 1 (i.e., the functions associated with the Basics module) is selected at a step 504, and any function switch actions are processed according to play pattern 1. If module 100 is not installed, the state of the module detection switches at locations MD0 and MD1 are evaluated to determine if Music module 200 is installed at a decision block 506. If so, play pattern 2 (i.e., the functions associated with the Music module) is selected at a step 508. Similarly, if module 200 is not installed, the state of the module detection switches is evaluated to determine whether Games module 300 is installed at a decision step 510. If so, play pattern 3 (i.e., the functions associated with the Games module) is selected at a step 512. If none of the expected modules are installed, play pattern 4 (a default set of functions) is selected at a step 514.

Figure 9:
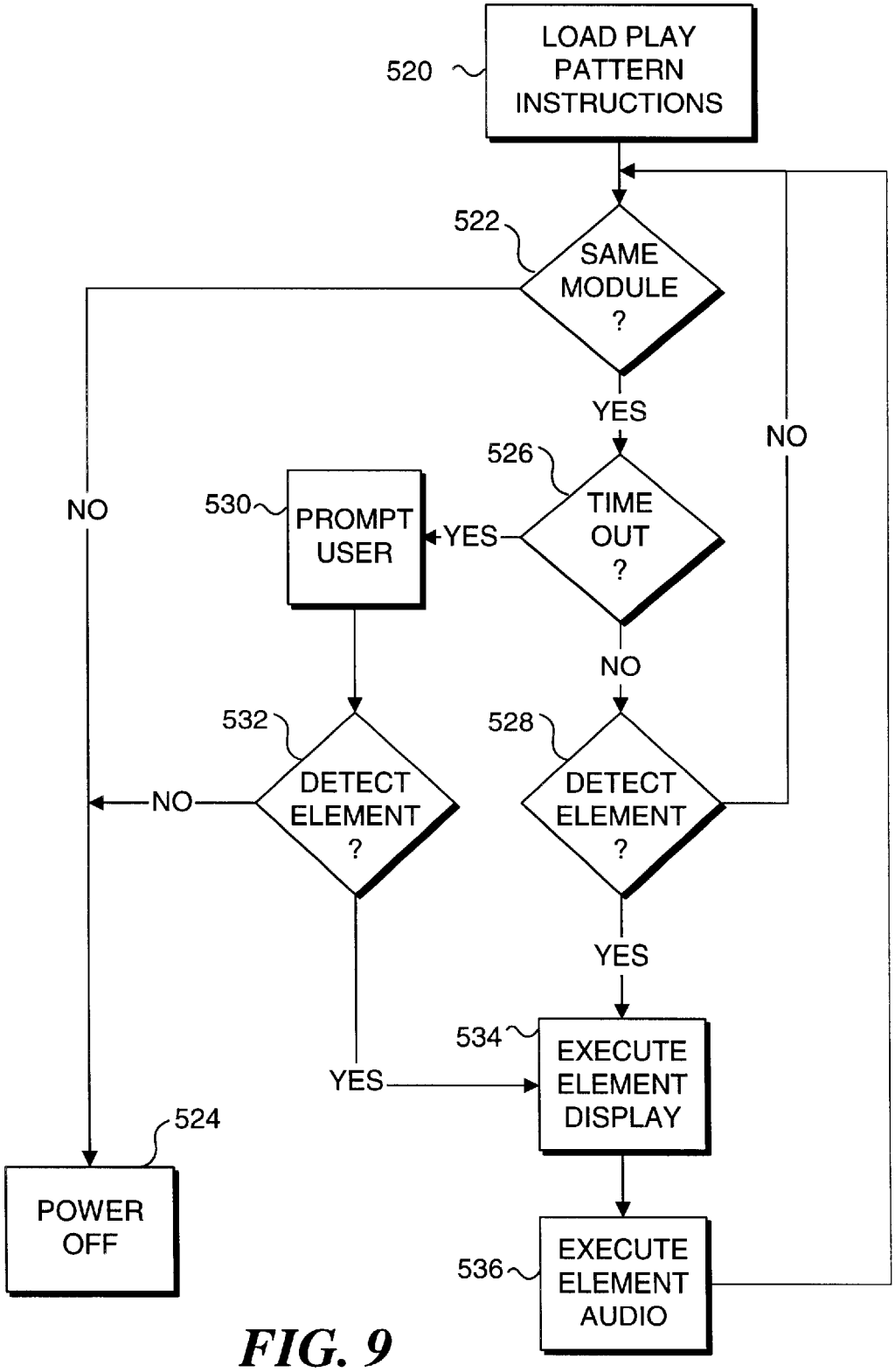
FIG. 9 is a flow diagram of the logic used by the present invention for processing a play pattern associated with a detected removable module.

FIG. 9 is a flow diagram of logic for processing a play pattern of the functions associated with a given module in response to the user moving one of the movable elements on that module. At a block 520, instructions corresponding to the selected module play pattern are loaded into memory. At a decision block 522, the system determines whether the installed module was removed from (and/or replaced in) the base unit. If so, power is shut off at a block 524 to conserve the battery and to simplify processing. If the same module is still in place, a decision block 526 checks whether a first predetermined time has elapsed since a function switch state change was detected. If not, a decision block 528 detects whether an element was moved. If no element was moved, the logic loops back to decision block 522.

However, if the first predetermined time has elapsed at decision block 526, the user is prompted to move an element on the module, at a block 530. A decision block 532 then checks whether the user responded to the prompt within a second predetermined time. If the user did not respond, power is shut off at block 524. If the user moved an element within the second predetermined time, the corresponding display instruction is executed at a block 534. Similarly, if the first predetermined time did not elapse and an element movement is detected at a decision block 528, the corresponding display instruction is executed at a block 534. At approximately the same time, the corresponding audio instruction is executed at a block 536. Once execution of the audio instruction has completed, the logic loops back to decision block 522, and repeats the entire process, as long as the module remains in place and power is applied.

The present invention can also be used for many other types of applications and devices besides toys. For example, a plurality of removable cellular telephone face plates could be used to provide a variety of functions on a common base unit. One face plate might cause the base unit to provide functions relevant to a business user, while another face plate may cause the base unit to provide functions relevant to a student, such as playing MP3 music stored in the base unit. Other examples of alternative applications of the present invention include a computer keyboard, a personal data assistant (PDA), and an Internet appliance with a plurality of removable keypad face plates. One face plate can cause the base unit to provide functions relevant to an engineering professional, while another face plate could cause the base unit to provide functions relevant to a home user. Although a selector switch could be used to activate the various functions, it would likely be desirable to instead provide multiple face plates in order to simplify and customize the user interface. Also, multiple modules could be used on a single base. For example, on a keyboard, an alphanumeric module could be used for the alphabetic portion of the keyboard, while a numeric module is used for the numeric portion of the keyboard. Similarly, a third module could be used for the function key portion of the keyboard. Alternatively, a jigsaw puzzle of toy modules could be used on a base with multiple sets of module detection switches. These alternatives would enable mixing and matching modules to suit more specific needs.

Preferably, the movable elements and other aspects of the removable modules are purely mechanical. However, instead of mechanically activating switches in the base unit, the movable elements could be employed to change the state of electrical contacts exposed on the base unit. For example, the movable elements could simply short contacts together with a conductive bar on the base of the movable element; or, the movable elements could interrupt a light beam to actuate a photo-transistor switch; or the movable elements could include a magnet to trigger a Hall effect switch. Thus, it is contemplated that a variety of different techniques could be used to enable the base unit to respond to the movement of a movable element on a module that is coupled to the base unit.

Although the present invention has been described in connection with the preferred form of practicing it and modifications thereto, those of ordinary skill in the art will understand that many other modifications can be made to the present invention within the scope of the claims that follow. Accordingly, it is not intended that the scope of the invention in any way be limited by the above description, but instead be determined entirely by reference to the claims that follow.

What is claimed is:

1. A method for determining a functional behavior of a base of an electronic device as a function of at least one of a plurality of different modules that is coupled to the base, comprising the steps of:

(a) enabling a user to couple a selected module from among the plurality of different modules to the base, wherein the selected module comprises only mechanical elements including a housing and a plurality of separately actuatable elements that are each movable relative to the housing;

(b) detecting which module from among the plurality of different modules has been coupled to the base, as a function of a state of at least one switch disposed in the base, the state of said at least one switch being determined by a configuration of the selected module; and (c) enabling a set of functions to be performed by the base, each function being performed in response to movement of one of the plurality of separately actuatable elements of the selected module, a different set of functions being enabled for each of the plurality of different modules in response to the module that was detected, so that the functional behavior of the base is dependent upon the module that is coupled to the base by the user.

2. The method of claim 1, further comprising the step of providing one of a flat and a recess in each of the modules corresponding to a location in the base of each switch disposed on the base for detecting the selected module.

3. The method of claim 1, wherein the step of enabling a set of functions to be performed, comprises the step of selecting a set of functions associated with the selected module from a plurality of different sets of functions.

4. The method of claim 1, wherein the base includes at least one function switch, which when activated, causes at least one function of the base to be implemented, further comprising the steps of:

(a) detecting the state of said at least one function switch in response to movement of the one of the plurality of separately actuatable elements of the selected module; and (b) implementing a function associated with said at least one function switch, when the movement of the one of the plurality of separately actuatable elements actuates said at least one function switch.

5. The method of claim 1, further comprising the step of displaying a pattern based on the selected module that was detected.

6. The method of claim 1, further comprising the step of producing an audible sound based on the selected module that was detected.

7. The method of claim 1, further comprising the step of terminating power as a result of the selected module being removed from the base.

8. The method of claim 4, wherein the base includes a plurality of function switches, said plurality of function switches include a pair of function switches connected in parallel and disposed in different locations on the base, further comprising the step of enabling only one of the pair of function switches to be activated by moving one of the plurality of separately actuatable elements of one of the plurality of different modules, and only the other function switch of the pair of function switches to be activated by moving a different one of the plurality of separately actuatable elements of a different module.

9. The method of claim 1, wherein the one of the plurality of separately actuatable elements can be moved in a specific manner, said specific manner being one of pushing, sliding, toggling, and spinning.

10. The method of claim 1, further comprising the step of implementing successive functions in response to a repeated movement of the one of the plurality of separately actuatable elements.

11. A method to determine a function to be implemented by a base of an electronic device, wherein a selected one of a plurality of modules can be coupled to the base, each module of the plurality of modules being associated with a different set of functions and comprising only mechanical elements, including a plurality of individually movable elements, comprising the steps of:

(a) detecting a state of each of a first set of switches in the base, the state of each of the first set of switches being controlled by a configuration of the module that is installed in the base;

(b) enabling a user to change the state of a switch from among a plurality of switches in a second set of switches in the base by moving one of the plurality of individually movable elements comprising the module that is installed in the base;

(c) detecting the state of the first set of switches and the second set of switches; and (d) implementing a function with the base, said function being determined by:

(i) the state of the first set of switches, which determine the set of functions that are used; and (ii) the state of the switch from among the second set of switches that was changed by the user moving said one of the plurality of individually movable elements.

12. The method of claim 11, wherein the step of detecting comprises the step of detecting the state of the first set of switches when a module is installed on the base.

13. The method of claim 11, wherein the step of detecting comprises the step of detecting the state of the first set of switches when the base is electrically energized.

14. The method of claim 11, further comprising the step of providing a plurality of different sets of functions, wherein each set is associated with one of the plurality of modules, and wherein each set includes a plurality of different functions that are related by a common theme.

15. The method of claim 11, wherein the step of implementing a function, comprises the step of producing a sensation detectable by a user.

16. The method of claim 15, wherein the step of producing a sensation, comprises the step of displaying a pattern on a display.

17. The method of claim 16, wherein the step of displaying a pattern comprises the step of lighting at least one of a plurality of lights.

18. The method of claim 17, wherein the step of lighting at least one of a plurality of lights comprises the step of lighting at least two lights to display a plurality of different colors.

19. The method of claim 15, further comprising the step of changing the sensation in response to movement by the user of an individually movable element.

20. The method of claim 15, further comprising the step of producing a sequence of sensations to define a game pattern.

21. The method of claim 15, wherein the step of producing a sensation comprises the step of producing an audible sound.

22. The method of claim 11, further comprising the step of providing an indicia of the function performed by an individually movable element on the movable element.

23. The method of claim 22, wherein the indicia comprises at least one of a configuration of the individually movable element, a label applied to the individually movable element, a color of the individually movable element, and a pattern formed on the individually movable element.

24. The method of claim 11, wherein the step of enabling a user to change the state of a switch comprises the step of enabling a user to selectively actuate more than one switch with one individually movable element.

25. The method of claim 24, wherein the step of enabling a user to selectively actuate more than one switch comprises the step of enabling a user to move an individually movable element to selectively actuate a pair of switches by one of sliding, rotating, and toggling the individually movable element.

26. Apparatus that implements a selected function from among a plurality of different sets of functions, comprising:

(a) a plurality of modules, each module of the plurality of modules being associated with a different set of functions and comprising only mechanical elements, including at least one individually movable element that is adapted to be individually moved by a user to selectively implement a function from the set of functions associated with the module; and (b) a base that includes an electronic circuit used to implement the plurality of different sets of functions, said base being configured to couple with a selected module from the plurality of modules and including:

(i) at least one module switch, the state of said at least one module switch being determined by a configuration of the selected module when the selected module is coupled to the base, the state of said at least one module switch determining the set of functions that is to be used with the selected module; and (ii) at least one function switch, the state of said at least one function switch being changed by movement of the at least one individually movable element included on the selected module, the state of said at least one function switch and the state of said at least one module switch determining which of the plurality of functions that the base implements.

27. The apparatus of claim 26, wherein the base comprises a toy and wherein the plurality of different sets of functions implemented by the base comprise a plurality of educational behaviors.

28. The apparatus of claim 26, further comprising a logic device disposed in the base, said logic device implementing the plurality of different sets of functions.

29. The apparatus of claim 28, wherein the logic device comprises a processor and a memory in which machine instructions are stored, said machine instructions being executed by the processor to implement the plurality of different sets of functions.

30. The apparatus of claim 26, wherein each of the plurality of modules includes at least one of a recess that does not actuate the at least one module switch and a flat that actuates the at least one module switch when the module is coupled to the base.

31. The apparatus of claim 26, further comprising a display that displays a pattern as a function of the state of the at least one function switch.

32. The apparatus of claim 31, wherein the display comprises a light display in which different colors of light are selectively produced.

33. The apparatus of claim 31, wherein the display displays a different pattern in response to movement of the at least one individually movable element.

34. The apparatus of claim 31, wherein the display displays a sequence of patterns in response to actuation of the at least one function switch.

35. The apparatus of claim 26, wherein the base further comprises a speaker that produces an audible sound as a function of the state of the at least one function switch.

36. The apparatus of claim 35, wherein the audible sound produced by the speaker changes based upon movement of the at least one movable element.

37. The apparatus of claim 26, wherein the at least one individually movable element comprises one of a button, a slider, a toggle, and a spinner.

38. The apparatus of claim 26, wherein movement of the at least one individually movable element selectively actuates more than one function switch.

39. The apparatus of claim 26, wherein the at least one individually movable element includes an indicia of the function to be selectively implemented by moving the at least one individually movable element.

40. The apparatus of claim 39, wherein the indicia includes one of a configuration of the individually movable element, a label on the individually movable element, a color of the individually movable element, and a pattern on the individually movable element.

41. The apparatus of claim 26, wherein the at least one individually movable element includes one of a push rod, a bar, and a gear that actuates the at least one function switch when the at least one individually movable element is moved.

42. A system that associates a functional behavior of a base with each of a plurality of different modules, each module comprising only mechanical elements, comprising:

(a) a logic device;

(b) a plurality of module switches coupled to the logic device, the state of said plurality of module switches being determined by a configuration of a selected module when the selected module is coupled to the base, the state of said plurality of module switches determining one of a plurality of functional behaviors associated with the selected module, a different functional behavior being associated with each module of the plurality of different modules;

(c) a plurality of function switches coupled to the logic device, the state of said plurality of function switches being determined by movement of individually movable elements included on the selected module, the state of said plurality of function switches and the state of said plurality of module switches determining which of a plurality of functions the base is to perform; and (d) said logic device implementing functions associated with the selected module by:

(i) detecting the state of the plurality of module switches; and (ii) selecting one of the plurality of functional behaviors associated with the selected module based on the detected state of the plurality of module switches and the detected state of the plurality of function switches.

43. The system of claim 42, wherein the selected functional behavior comprises a plurality of functions that correspond to a theme.

44. The system of claim 42, further comprising a memory coupled to the logic device in which a plurality of machine instructions are stored, the machine instructions causing the logic device to perform a function from the selected functional behavior in response to actuation of a function switch.

45. The system of claim 44, wherein the machine instructions further cause the logic device to perform a pattern of functions in response to actuation of a function switch.

46. The system of claim 42, further comprising a display coupled to the logic device, and display displaying a pattern in response to the logic device, to implement a function from the plurality of functional behaviors associated with the selected module.

47. The system of claim 42, further comprising a speaker coupled to the logic device, said speaker producing a sound in response to the logic device, to implement a function from the plurality of functional behaviors associated with the selected module.

* * * * *

UNITED STATES PATENT AND TRADEMARK OFFICE

CERTIFICATE OF CORRECTION

PATENT NO. : 6,595,780 B2
DATED : July 22, 2003
INVENTOR(S) : Singh et al.

It is certified that error appears in the above-identified patent and that said Letters Patent is hereby corrected as shown below:

Title page,
Item [75], Inventors, please add -- Brian D. Williams --

Signed and Sealed this

Twenty-seventh Day of January, 2004

JON W. DUDAS
*Acting Director of the United States Patent and Trademark Office*